US010400536B2

(12) United States Patent
Seshadri et al.

(10) Patent No.: US 10,400,536 B2
(45) Date of Patent: Sep. 3, 2019

(54) MODEL-BASED PUMP-DOWN OF WIRELINE TOOLS

(71) Applicant: HALLIBURTON ENERGY SERVICES, INC., Houston, TX (US)

(72) Inventors: Muralidhar Seshadri, Sugar Land, TX (US); Daniel E. Viassolo, Katy, TX (US); Randy Coles, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 82 days.

(21) Appl. No.: 15/504,608

(22) PCT Filed: Sep. 18, 2014

(86) PCT No.: PCT/US2014/056363
§ 371 (c)(1),
(2) Date: Feb. 16, 2017

(87) PCT Pub. No.: WO2016/043760
PCT Pub. Date: Mar. 24, 2016

(65) Prior Publication Data
US 2017/0241221 A1 Aug. 24, 2017

(51) Int. Cl.
*E21B 47/024* (2006.01)
*E21B 23/08* (2006.01)
(Continued)

(52) U.S. Cl.
CPC ..... *E21B 23/08* (2013.01); *E21B 41/0092* (2013.01); *E21B 47/024* (2013.01); *E21B 47/065* (2013.01)

(58) Field of Classification Search
CPC .... E21B 23/08; E21B 47/065; E21B 41/0092; E21B 47/024
See application file for complete search history.

(56) References Cited

U.S. PATENT DOCUMENTS 3,957,115 A 5/1976 Kerzee et al.
4,637,468 A 1/1987 Derrick
(Continued)

FOREIGN PATENT DOCUMENTS

WO 2009/143469 11/2006
WO 2012/021126 2/2012
WO 2014/014438 1/2014

OTHER PUBLICATIONS

PCT International Search Report and Written Opinion, dated May 29, 2015, Appl. No. PCT/US2014/0569363, "Model-Based Pump-Down of Wireline Tools," filed Sep. 18, 2014, 14 pgs.
(Continued)

*Primary Examiner* — Robert E Fennema
*Assistant Examiner* — Marzia T Monty
(74) *Attorney, Agent, or Firm* — Alan Bryson; C. Tumey Law Group PLLC

(57) ABSTRACT

A pump-down method includes deploying a tool in a well via a wireline and measuring a tension of the wireline. The method also includes determining a difference between the measured tension and a reference tension. The method also includes updating at least one of a pump rate and a wireline speed used for pump-down of the tool based on the difference and at least one control parameter obtained at least in part from prediction model results.

18 Claims, 4 Drawing Sheets

(51) Int. Cl.
*E21B 41/00* (2006.01)
*E21B 47/06* (2012.01)

(56) References Cited

U.S. PATENT DOCUMENTS

| | | | | |
|---|---|---|---|---|
| 4,949,045 | A | 8/1990 | Clark et al. | |
| 6,079,505 | A * | 6/2000 | Pignard | E21B 23/14 166/66 |
| 6,138,764 | A | 10/2000 | Scarsdale | |
| 6,302,203 | B1 | 10/2001 | Rayssiguier et al. | |
| 6,684,952 | B2 | 2/2004 | Brockman et al. | |
| 6,727,827 | B1 | 4/2004 | Edwards et al. | |
| 7,900,893 | B2 | 3/2011 | Teurlay et al. | |
| 2002/0077753 | A1 * | 6/2002 | Kelly | G01V 11/002 702/1 |
| 2002/0198661 | A1 * | 12/2002 | Strickland | E21B 47/04 702/6 |
| 2004/0064292 | A1 * | 4/2004 | Beck | E21B 43/126 702/182 |
| 2007/0181304 | A1 | 8/2007 | Rankin et al. | |
| 2009/0174409 | A1 | 7/2009 | Coates et al. | |
| 2009/0205867 | A1 * | 8/2009 | Reckmann | E21B 47/024 175/24 |
| 2011/0068794 | A1 | 3/2011 | Coates | |
| 2011/0128003 | A1 | 6/2011 | Thompson et al. | |
| 2012/0017673 | A1 | 1/2012 | Godager | |
| 2012/0024050 | A1 | 2/2012 | Godager | |
| 2013/0110402 | A1 | 5/2013 | Godager | |
| 2013/0118762 | A1 | 5/2013 | Kellner | |
| 2013/0138254 | A1 * | 5/2013 | Seals | E21B 23/08 700/282 |
| 2016/0245049 | A1 * | 8/2016 | Mogensen | E21B 43/25 |
| 2016/0290077 | A1 * | 10/2016 | Aske | E21B 43/128 |

OTHER PUBLICATIONS

Alden, Mark, et al., "Advancing Downhole Conveyance," Oilfield Review, Oct. 1, 2004, pp. 30-43, vol. 16, Autumn, Schlumberger Limited, Houston, Texas, United States.

Los Alamos National Laboratory, "INFICOMM-Reflective Wireless Communications System," LALP-05-049, Sep. 2006.

Schlumberger, "Wireline High-Tension Conveyance System," Presentation, 2013, pp. 1-32, Schlumberger Limited, Houston, Texas, United States, Available at: http://www.slb.com/services/characterization/petrophysics/wireline/wireline_conveyance.aspx.

* cited by examiner

MODEL-BASED PUMP-DOWN OF WIRELINE TOOLS

BACKGROUND

Oil and gas exploration and production generally involve drilling boreholes, where at least some of the boreholes are converted into permanent well installations such as production wells, injections wells, or monitoring wells. To complete a well installation, a liner or casing is lowered into the borehole and is cemented in place. Further, perforating, packing, and/or other operations may be performed along the well installation to create different production or injection zones.

There are situations where gravity alone is insufficient to convey a wireline tool for well completion operations and/or well intervention operations. For example, if the clearance between a wireline tool and an inner diameter of a casing or liner is small, the tool can become stuck. Further, gravity alone will not convey a wireline tool along an angled or horizontal section of a well. In such scenarios, pump-down operations are performed.

For conventional pump-down operations, water or another fluid is pumped into a well to help convey or "push" a wireline tool to a desired position. Two controllable parameters for pump-down operations are the pump rate and the wireline speed. Usually, the pump rate and the wireline speed are controlled manually by two different operators in communication with each other using radio transceivers. If control of the pump rate and the wireline speed is mismanaged, a "pump off" may occur resulting in expensive tool retrieval operations and lost time. Further, if the pump rate is too high, the pressure at the surface of the well may cause failure of wellhead components. To avoid pump off events or wellhead failure, conservative control of the pump rate and wireline speed is possible, but results in lost time.

BRIEF DESCRIPTION OF THE DRAWINGS

Accordingly, there are disclosed in the drawings and the following description various pump-down control methods and systems that employ at least one control parameter obtained at least in part from prediction model results. In the drawings.

Figure 2A:
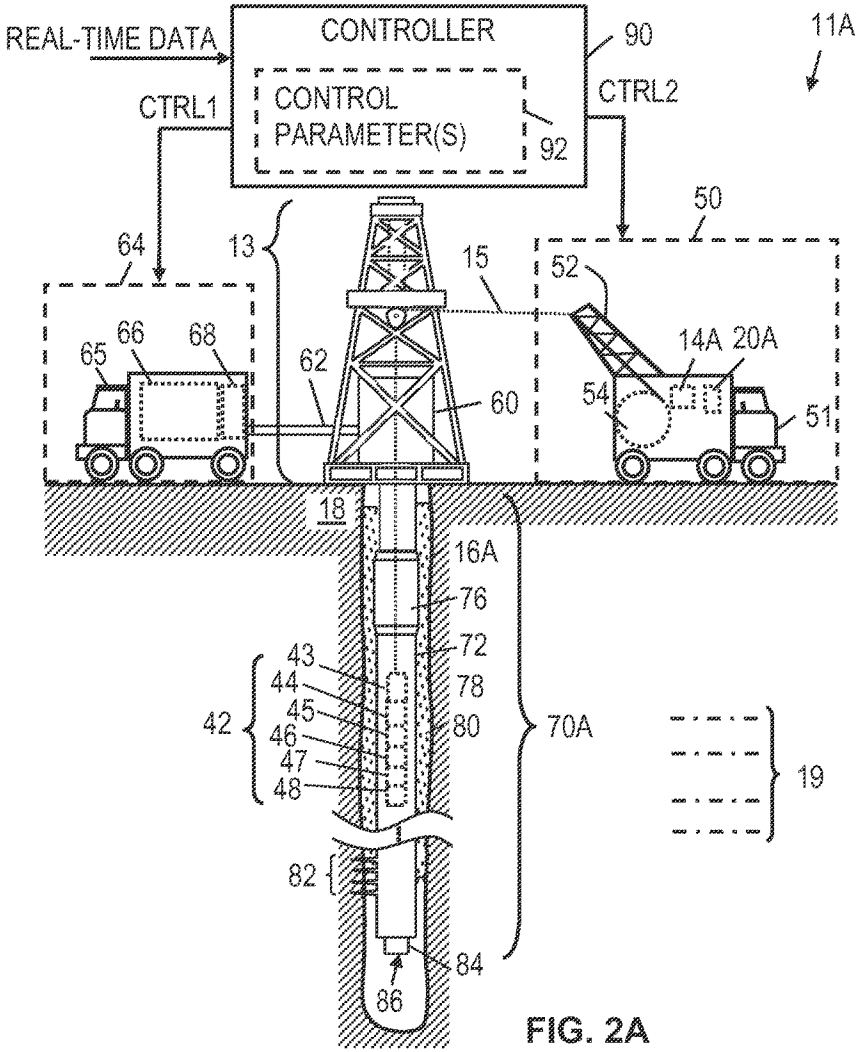
FIGS. 2A and 2B are schematic diagrams showing pump-down environments.

It should be understood, however, that the specific embodiments given in the drawings and detailed description do not limit the disclosure. On the contrary, they provide the foundation for one of ordinary skill to discern the alternative forms, equivalents, and modifications that are encompassed together with one or more of the given embodiments in the scope of the appended claims.

DETAILED DESCRIPTION

Disclosed herein are various pump-down methods and systems that employ at least one control parameter depending at least in part on prediction model results. The prediction model used to obtain the prediction model results may correspond to a physics-based model and/or a statistics-based model. The prediction model may use sensor-based data collected during other pump-down jobs, sensor-based data collected while drilling and/or logging in a well for which a pump-down job is to be performed, sensor-based data collected during a current pump-down job, and/or simulated well data or pump-down parameters. Examples of measurable or simulated parameters that may be taken into account by the prediction model include tool inclination, wireline speed, pump rate, tool geometry, temperature, and depth, and/or other parameters that affect the friction or buoyant forces applied to a wireline tool during pump-down operations.

In at least some embodiments, prediction model results are used to determine at least one control parameter for a controller prior to a pump-down job starting. Additionally or alternatively, prediction model results and related control parameters may be dynamically adjusted during a pump-down job as additional sensor-based data becomes available. In either case, the at least one control parameter is used by the controller to adjust at least one of a pump rate and a wireline tension. For example, the control parameter obtained at least in part from prediction model results may correspond to an error scaling factor. In such case, the controller outputs a pump rate control signal and/or a wireline speed control signal by applying one or more of such error scaling factors to the difference between a measured wireline tension and a reference wireline tension. In at least some embodiments, the reference tension that is compared with the measured tension is adjustable based on predetermined criteria such as tool inclination, temperature, and/or other measurable parameters that affect the friction or buoyant forces applied to a wireline tool during pump-down operations. The pump rate control signal and/or the wireline speed control signal output from a controller having at least one control parameter obtained at least in part from prediction model results may be used to automate pump-down control or to dynamically provide instructions to one or more operators during a pump-down job.

An example pump-down system includes a pump, a wireline reel, and a gauge to measure a wireline tension. The system also includes a controller in communication with at least one of the pump and the wireline reel. The controller updates at least one of a pump rate of the pump and a wireline speed of the wireline reel based on a difference between the measured wireline tension and a reference wireline tension and based on at least one control parameter obtained at least in part from prediction model results. An example pump-down method includes deploying a tool in a well via a wireline and measuring a tension of the wireline. The method also may include determining a difference between the measured tension and a reference tension. The method also includes updating at least one of a pump rate and a wireline speed used for pump-down of the tool based on the difference and at least one control parameter obtained at least in part from prediction model results. With the disclosed pump-down methods and systems, pump-down operations can be expedited without expensive pump-offs caused by exceeding a wireline's tension rating. As used herein, a "pump off" refers to separation of the tool from a surface wireline reel or other deployment mechanism that enables lowering and raising the tool in a borehole. Such separation may be due to the wireline breaking or to a connection between the tool and the wireline breaking.

The disclosed pump-down method and systems expedite positioning of a tool at one or more points along a vertical or horizontal well with reduced risk of pump off and/or wellhead failure compared to reactionary or manual pump-down operations (e.g., one or more operators manually adjusting a pump rate or wireline speed using a wireline tension read-out). Once the disclosed pump-down operations move the tool to a desired position, a task is performed. Some example tasks include logging, matrix and fracture stimulation, wellbore cleanout, perforating, completion, casing, workover, production intervention, nitrogen kickoff, sand control, well circulation, fishing services, sidetrack services, mechanical isolation, and/or plugging. The value of expediting pump-down operations while avoiding pump-offs as disclosed herein increases as the length of wells increases.

Figure 1:
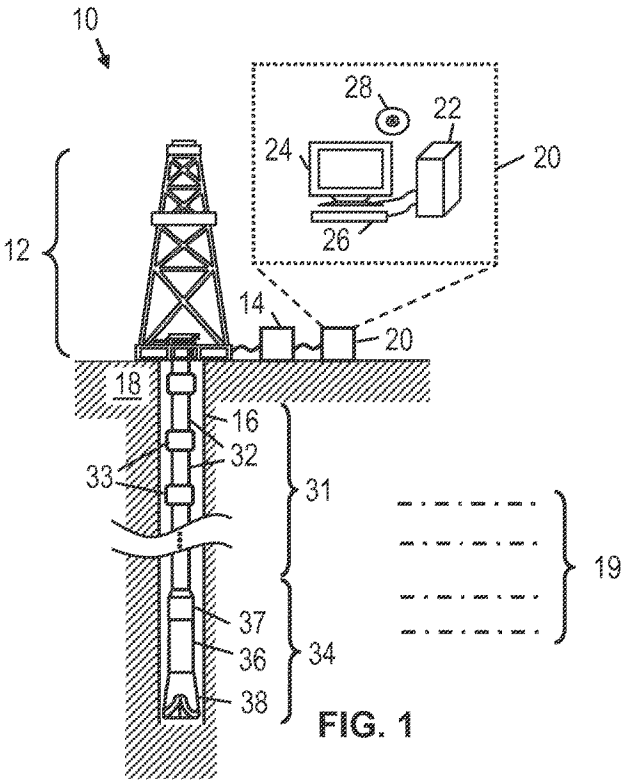
FIG. 1 is a schematic diagram showing a drilling environment.

The disclosed pump-down methods and systems are best understood when described in an illustrative usage context. FIG. 1 shows an illustrative drilling environment 10, where a drilling assembly 12 lowers and/or raises a drill string 31 in a borehole 16 that penetrates formations 19 of the earth 18. The drill string 31 is formed, for example, from a modular set of drill pipe sections 32 and adaptors 33. At the lower end of the drill string 31, a bottomhole assembly 34 with a drill bit 38 removes material from the formation 18 using known drilling techniques. The bottomhole assembly 34 also includes one or more drill collars 37 and may include a logging tool 36 to collect measure-while-drilling (MWD) and/or logging-while-drilling (LWD) measurements.

In FIG. 1, an interface 14 at earth's surface receives the MWD and/or LWD measurements via mud based telemetry or other wireless communication techniques (e.g., electromagnetic, acoustic). Additionally or alternatively, a cable (not shown) including electrical conductors and/or optical waveguides (e.g., fibers) may be used to enable transfer of power and/or communications between the bottomhole assembly 34 and earth's surface. Such cables may be integrated with, attached to, or inside components of the drill string 31 (e.g., IntelliPipe sections may be used).

The interface 14 may perform various operations such as converting signals from one format to another, filtering, demodulation, digitization, and/or other operations. Further, the interface 14 conveys the MWD data, LWD data, and/or data to a computer system 20 for storage, visualization, and/or analysis. Additionally or alternatively to processing MWD or LWD data by a computer system at earth's surface, such MWD or LWD data may be partly or fully processed by one or more downhole processors (e.g., included with bottomhole assembly 34).

In at least some embodiments, the computer system 20 includes a processing unit 22 that enables visualization and/or analysis of MWD data and/or LWD data by executing software or instructions obtained from a local or remote non-transitory computer-readable medium 28. The computer system 20 also may include input device(s) 26 (e.g., a keyboard, mouse, touchpad, etc.) and output device(s) 24 (e.g., a monitor, printer, etc.). Such input device(s) 26 and/or output device(s) 24 provide a user interface that enables an operator to interact with the logging tool 36 and/or software executed by the processing unit 22. For example, the computer system 20 may enable an operator to select visualization and analysis options, to adjust drilling options, and/or to perform other tasks. Further, the MWD data and/or LWD data collected during drilling operations may facilitate determining the location of subsequent well intervention operations and/or other downhole operations, where pump-down operations are performed as described herein to position a tool along a well.

At various times during the drilling process, the drill string 31 shown in FIG. 1 may be removed from the borehole 16. With the drill string 31 removed, pump-down operations of a wireline (or coiled tubing) tool may be performed. In accordance with at least some embodiments, the disclosed pump-down operations are performed in a completed or partially-completed well environment such as the pump-down environment 11A of FIG. 2A or the pump-down environment 11B of FIG. 2B.

In pump-down environment 11A of FIG. 2A, a vertical well 70A is represented, where a drilling rig has been used to drill borehole 16A that penetrates formations 19 of the earth 18 in a typical manner (see e.g., FIG. 1A). For the vertical well 70A, a casing string 72 is positioned in the borehole 16A. The casing string 72 includes, for example, multiple tubular casing sections (usually about 30 feet long) connected end-to-end by couplings 76. It should be noted that FIG. 2A is not to scale, and that casing string 72 typically includes many such couplings 76. Further, the vertical well 70A may include cement slurry 80 that has been injected into the annular space between the outer surface of the casing string 72 and the inner surface of the borehole 16 and allowed to set. Further, in at least some embodiments of the vertical well 70A, a production tubing string 84 has been positioned in an inner bore of the casing string 72.

A function of the vertical well 70A is to guide a desired fluid (e.g., oil or gas) from a section of the borehole 16A to earth's surface. In at least some embodiments, perforations 82 may be formed at one or more points along the borehole 16A to facilitate the flow of a fluid from a surrounding formation into the borehole 16A and thence to earth's surface via an opening 86 at the bottom of the production tubing string 84. Note: the vertical well 70A is illustrative and not limiting on the scope of the disclosure. For example, other wells may be configured as injection wells or monitoring wells. In general, the pump-down operations described herein can be applied to any well that has perforations 82, fractures, and/or other fluid paths capable of accepting pumped fluid. Further, a pump-down interface 60 is needed to accept new fluid, to maintain fluid pressure, and to enable wireline conveyance of wireline tool string 42.

In at least some embodiments, the pump-down interface 60 may be part of a derrick assembly 13 that facilitates lowering and raising wireline tool string 42 via cable 15. The cable 15 includes, for example, electrical conductors and/or optical fibers for conveying power to the wireline tool string 60. The cable 15 may also be used as a communication interface for uphole and/or downhole communications. In at least some embodiments, the cable 15 wraps and unwraps as needed around cable reel 54 when lowering or raising the wireline tool string 42. As shown, the cable reel 54 may be part of a wireline assembly 50 that includes, for example, a movable facility or vehicle 50 having a cable guide 52. The moveable facility or vehicle 50 also includes interface 14A and computer system 20A, which may perform the same or similar operations as described for the interface 14 and computer system 20 of FIG. 1, except that wireline logging and pump-down operations are involved instead of LWD/MWD and drilling operations.

In at least some embodiments, the wireline tool string 42 includes various sections including power section 43, control/electronics section 44, actuator section 45, anchor section 46, logging section 47, and/or intervention tool section 48. The power section 43, for example, converts power received via cable 15 to one or more voltage/current levels for use by circuitry, electronics, actuators, and/or tools of the wireline tool string 42. The control/electronics section 44 enables uphole/downhole communications. Example uphole communications include logging data, sensor data, and/or tool diagnostics. Meanwhile, example downhole communications include instructions for logging, anchoring, actuation of moveable components, and/or operating tools. The control/electronics section 44 may also enable storage of instructions and/or collected data. Thus, not all data collected by the wireline tool string 42 during its deployment need be transmitted to earth's surface via cable 15 (i.e., at least some of the data may be stored and obtained from the wireline tool string 42 after retrieval). Further, not all instructions employed by the wireline tool string 42 need by received via cable 15 (i.e., at least some of the instructions may be pre-programmed).

The actuator section 45 provides actuation components used for anchoring, tools, and/or other movable components of the wireline tool string 42. Example actuators include hydraulic actuators with pistons and hydraulic feedlines and/or electromechanical actuators (e.g., with motors and interfaces to convert motor rotation to linear motion). The anchor section 68, for example, includes one or more anchor devices to contact an inner surface of a tubular (e.g., casing string 72 or production string 84), thereby maintaining the wireline tool string 42 in a fixed position as needed for well intervention operations and/or other downhole operations.

The logging section 47 includes, for example, one or more logging tools to collect data related to formations 19, borehole 16, casing string 72, production string 84, borehole fluid, formation fluid, and/or other downhole parameters. Further, the logging section 47 may include sensors or gauges for measuring wireline tension, tool inclination, temperature, and/or other parameters that affect pump-down operations. As needed, such sensors or gauges may be distributed anywhere inside or outside a tool body for the wireline tool string 42 and/or along the wireline 15. The intervention tool section 48 includes, for example one more intervention tools for modifying or fixing a casing string (e.g., casing string 72), a production string (e.g., production string 84), fractures, screens/filters, valves, and/or other features of vertical well 70A.

During pump-down of the wireline tool string 42, the pump-down interface 60 receives fluid from a pump assembly 64. For example, in some embodiments, the pump assembly 64 may correspond to a movable facility or vehicle 65 with a fluid storage tank 66 and a pump 68. As needed, the pump 68 directs fluid from the fluid storage tank 66 to the pump-down interface 60 via a feedline 62. In accordance with at least some embodiments, the operations of pump assembly 64 are directed by a controller 90 with one or more control parameters 92 obtained at least in part from prediction model results. As an example, the controller 90 may correspond to computer system 20A and/or another processing system in communication with the pump assembly 64 and/or the wireline assembly 50.

In accordance with at least some embodiments, the controller 90 provides a pump control signal (CTRL1) to pump assembly 64 and/or a wireline control signal (CTRL2) to the wireline assembly 50 based on the one or more control parameters obtained at least in part from prediction model results. For example, the one or more control parameters 92 may be determined for a pump-down job before deployment of the wireline tool string 42. Additionally or alternatively, the one or more control parameters 92 may be determined or adjusted during a pump-down job (in real-time or near real-time). The prediction model used to calculate the prediction model results from which the one or more control parameters 92 are obtained may be part of the controller 90 or part of a processing system in communication with the controller 90. Regardless of when the one or more control parameters 92 are determined, the controller 90 may use the one or more control parameters 92 as well as real-time data to determine CTRL1 and/or CTRL2. In at least some embodiments, the real-time data at least corresponds to a measured wireline tension (e.g., a surface wireline tension, a downhole wireline tension, or a combination thereof). For a combination tension, an average, a weighted average, or other combination of available measured tensions may be used. In at least some embodiments, the real-time data may also include tool inclination or other parameters from which tool inclination can be derived (e.g., tool depth or tool position relative to a known borehole trajectory). The tool inclination and/or other sensor-based measurements may be used by the controller 90 to adjust a reference tension to be compared with a measured wireline tension.

Figure 2B:
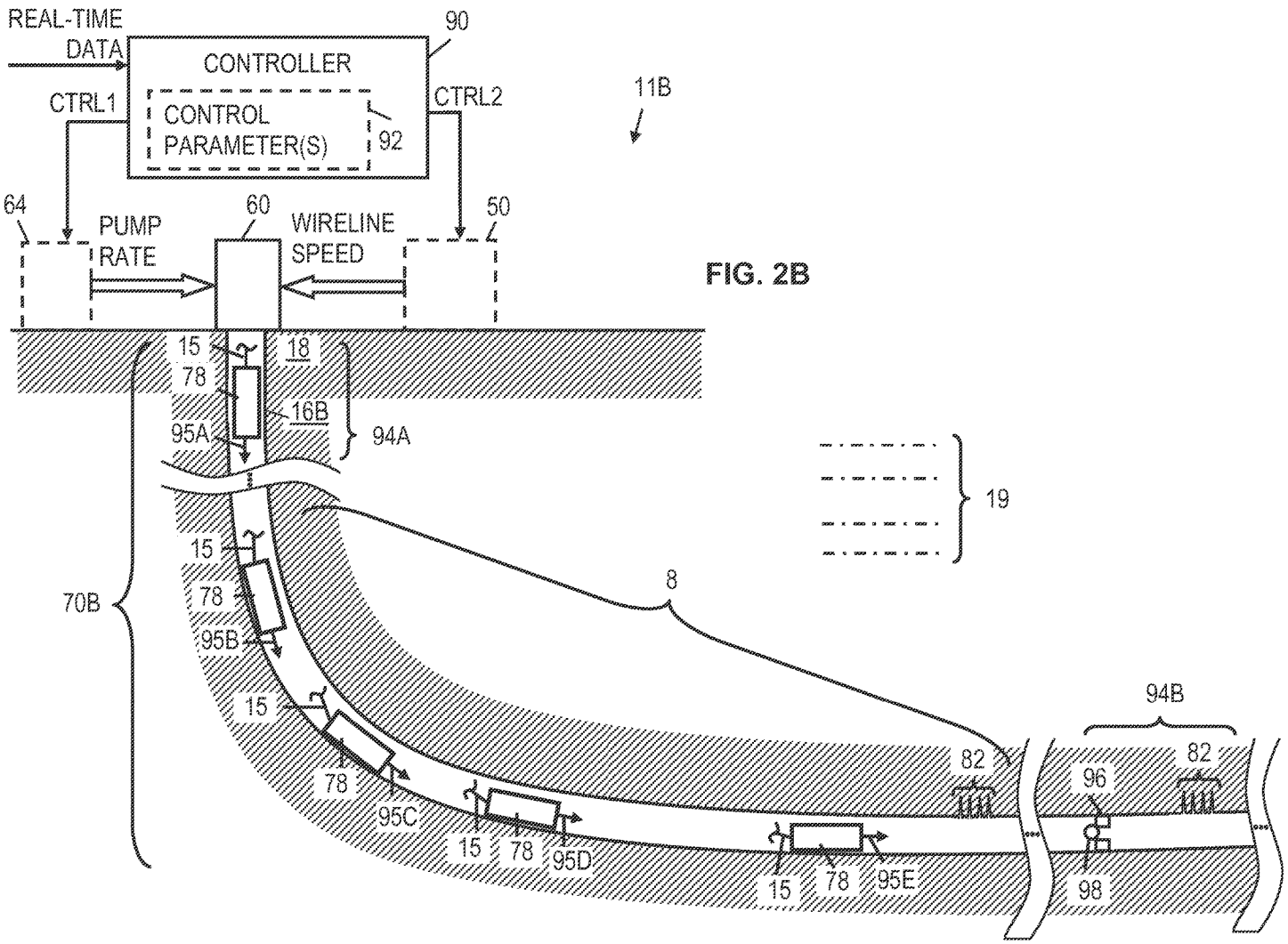

In pump-down environment 11B of FIG. 2B, a well 70B is formed using a drilling rig (e.g., see FIG. 1) to drill a borehole 16B that penetrates formations 19 of the earth 18. While not explicitly shown, the well 70B may include casing strings or production tubing strings. In contrast to the vertical well 16A shown for FIG. 2A, the well 70B of FIG. 2B includes a curved section 8 and a horizontal section 94. While the well 70B is shown with only one curved section 8, it should be appreciated that other wells may include many of such curved sections. Further, while the curved section 8 of well 70B represents a turn of approximately 90 degrees, it should be appreciated that curved sections of other wells may turn more than or less than 90 degrees. Further, while the straight-line sections 94A and 94B of well 70B are shown to be vertical or horizontal, it should be appreciated that straight-line sections of other wells may vary with regard to angle. As desired, perforations 82, zone dividers 96, and/or flow control elements 98 may be added along the well 70B. Typically, at least one perforation 82 is needed to enable pump-down operations.

In pump-down environment 11B, a wireline tool string 78 is deployed in well 70B (e.g., inside a casing string or production tubing string). In accordance with at least some embodiments, the wireline tool string 78 has sections similar to those described for wireline tool string 60, but may have a different outer diameter depending on the size of borehole 16B and related casing strings. As needed, the position of the wireline tool string 78 in well 70B is adjusted using pump-down operations. In pump-down environment 11B, the wireline tool string 78 is represented at multiple positions along the well 70B corresponding to different tool inclinations 95A-95E. For each tool inclination 95A-95E, the tension of the wireline 15 connecting the wireline tool string 78 to wireline assembly 50 varies and pump-down operations may need to be adjusted over time.

In accordance with at least some embodiments, pump-down operations are performed for pump-down environment 11B using a wireline assembly 50, a pump assembly 64, a pump-down interface 60, and a controller 90 as described previously for the pump-down environment 11A of FIG. 2A. One difference between the pump-down operations for pump-down environment 11A and the pump-down operations for pump-down environment 11B is that the wireline tool string 78 changes its inclination in well 70B over time, whereas the inclination of wireline tool string 42 in vertical well 70A stays the same. Accordingly, the pump-down operations for pump-down environment 11B may account for changes in tool inclination over time. Further, the pump-down operations for pump-down environments 11A and 11B may account for changes to the downhole temperature and/or other parameters that affect the amount of force applied to a wireline tool string during pump-down operations.

For pump-down environment 11B, the controller 90 provides a pump control signal (CTRL1) to pump assembly 64 and/or a wireline control signal (CTRL2) to the wireline assembly 50 based on one or more control parameters obtained at least in part from prediction model results. The one or more control parameters 92 may be determined for a pump-down job before deployment of the wireline tool string 78. Additionally or alternatively, the one or more control parameters may determined or adjusted during a pump-down job (in real-time or near real-time). The prediction model used to calculate the one or more control parameters 92 may be part of the controller 90 or part of a processing system in communication with the controller 90. Regardless of when the one or more control parameters 92 are determined, the controller 90 may use the one or more control parameters 92 as well as real-time data to determine CTRL1 and/or CTRL2. In at least some embodiments, the real-time data corresponds to a measured wireline tension (e.g., a surface wireline tension, a downhole wireline tension, or a combination thereof). For a combination tension, an average, a weighted average, or other combination of available measured tensions may be used. In at least some embodiments, the real-time data may also include tool inclination or other parameters from which tool inclination can be derived (e.g., tool depth or tool position relative to a known borehole trajectory). The tool inclination and/or other sensor-based measurements may be used by the controller 90 to adjust a reference tension to be compared with a measured wireline tension as described herein.

Figure 3:
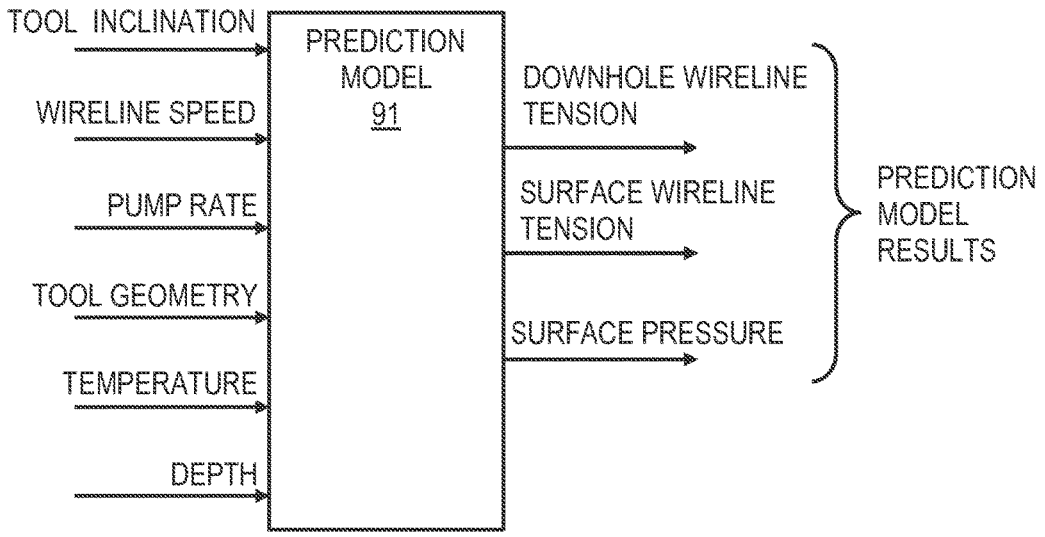
FIGS. 3-5 are block diagrams showing pump-down control options.
Figure 4:
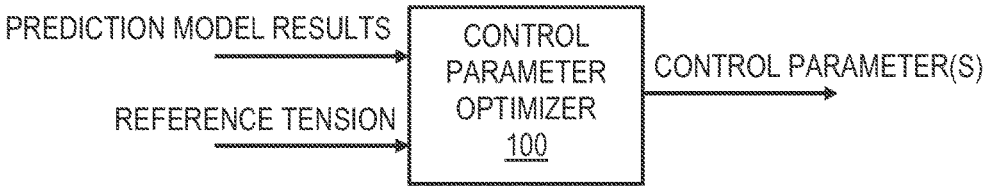
Figure 5:
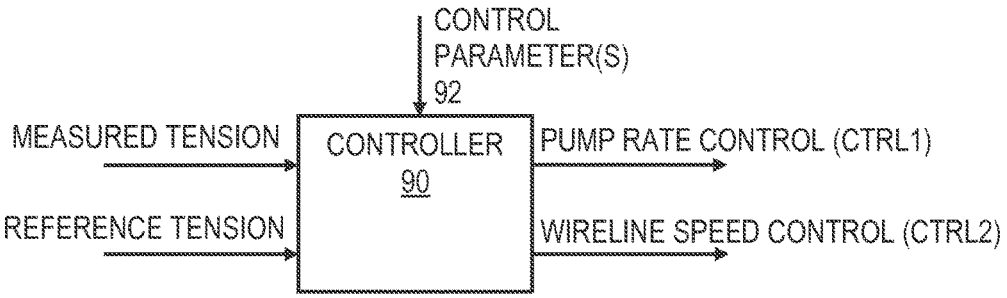

FIGS. 3-5 are block diagrams showing pump-down control options. In FIG. 3, a prediction model 91 determines various parameters related to pump-down control (the prediction model results) based on measured inputs and/or simulated inputs. The prediction model 91 may correspond to a physics-based model, a statistics-based model, or a combination thereof. For a physics-based model, the prediction model results may correspond to, for example, one or more values that balance the forces applied to a wireline tool string (e.g., wireline tool string 60 or 78) during pump-down operations. For a statistics-based model, the prediction model results may correspond to, for example, one or more values based on previously collected data and statistical correlations between the output values and different combinations of input values. In at least some embodiments, the prediction model results correspond to a downhole wireline tension, a surface wireline tension, and/or a surface pressure. Meanwhile, the inputs to the prediction model 91 may be a tool inclination, a wireline speed, a pump rate, a tool geometry (or relative tool geometry), a temperature, and/or a depth.

In FIG. 4, a control parameter optimizer 100 determines one or more control parameters to be employed by the controller 90 during pump-down operations. As an example, the control parameters may correspond to error scaling factors employed by the controller 90. In at least some embodiments, the inputs to control parameter optimizer 100 include the prediction model results (e.g., downhole wireline tension, surface wireline tension, and/or surface pressure) and a reference tension.

In FIG. 5, the controller 90 receives a measured tension and a reference tension as inputs and determines a pump rate control signal (CTRL1) and/or a wireline speed controller signal (CTRL2). For example, in at least some embodiments, controller 90 determines a difference or error between the measured tension and the reference tension, where the difference between the measured tension and the reference tension is used to adjust CTRL1 and/or CTRL2. More specifically, in at least some embodiments, the controller 90 may apply one or more control parameters 92 (e.g., received from control parameter optimizer 100) to the difference between the measured tension and the reference tension. Without limitation, the controller 90 may include a proportional-integral-derivative (PID) control loop, where the one or more control parameters 92 correspond to error scaling factors used by the PID control loop.

In different embodiments, the controller 90 may include the prediction model 91 and/or the control parameter optimizer 100. Alternatively, the controller 90 receives the one or more control parameters 92 from a "programming station" that includes the prediction model 91 and the control parameter optimizer 100. Regardless, the operations represented in FIGS. 3 and 4 may be performed before a pump-down job begins, during a pump-down job, and/or after a pump-down job. If real-time data is available during a pump-down job, the prediction model 91 may use the real-time data to dynamically determine prediction model results and update the one or more control parameters 92 used by the controller 90. As another option, the controller 90 may be pre-programmed with the one or more control parameters 92 based on prediction model results determined before the pump-down job begins. In such case, prediction model results may be obtained by applying simulated data and/or data collected from one or more previous pump-down jobs to the prediction model 91.

In at least some embodiments, the prediction model 91 and/or the control parameter optimizer 100 can be "trained" to improve its accuracy. Such training may occur before, during, and/or after a pump-down job. Additionally or alternatively to the one or more control parameters 92 being updated over time, the reference tension used by the controller 90 may be updated over time based on real-time data (e.g., tool inclination and/or temperature measurements). Further, a reference tension selection scheme may be adjusted over time in accordance with available parameters and/or learned selection criteria. In at least some embodiments, the reference tension to be used during pump-down operations is adjusted as needed in accordance with different tool inclinations and/or other measurable parameters.

Figure 6:
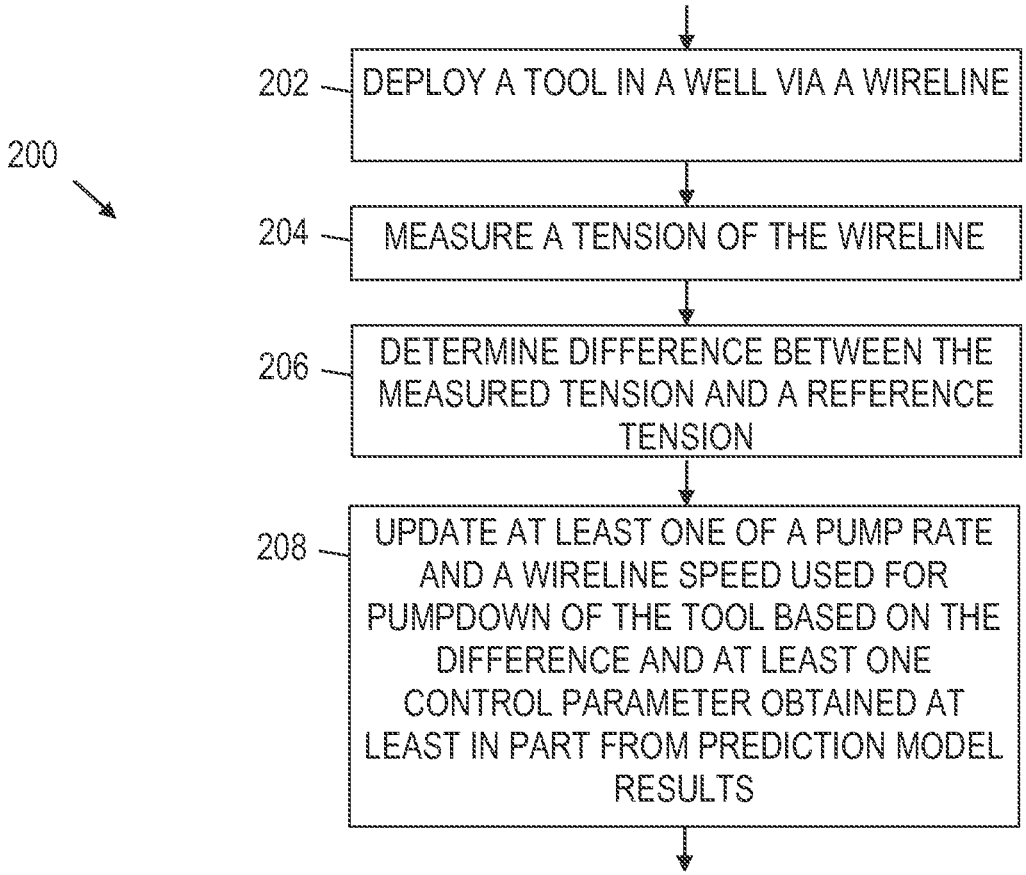
FIG. 6 is a flowchart showing a pump-down method.

FIG. 6 shows a method 200 for performing pump-down operations. As shown, the method 200 includes deploying a tool in a well via a wireline (block 202). Coiled tubing is another option for deploying a tool in a well. At block 204, a wireline tension in measured. At block 206, a difference between the measured tension and a reference tension is determined. At block 208, at least one of a pump rate and a wireline speed used for pump-down of the tool is updated based on the difference and one or more control parameters obtained at least in part from prediction model results. As described herein, the one or more control parameters (e.g., control parameter 92) may be obtained or updated before beginning a pump-down job, during a pump-down job, and/or after a pump-down job. In at least some embodiments, the one or more control parameters correspond to error scaling factors applied by a pump-down controller to the difference between the measured tension and the reference tension. Further, the reference tension may be updated during pump-down operations based on real-time data indicative of tool inclination, temperature, and/or other parameters that affect pump-down of a tool.

Embodiments Disclosed Herein Include:

A: A pump-down method that comprises deploying a tool in a well via a wireline, measuring a tension of the wireline, and determining a difference between the measured tension and a reference tension. The method also comprises updating at least one of a pump rate and a wireline speed used for pump-down of the tool based on the difference and at least one control parameters obtained at least in part from prediction model results.

B: A pump-down system that comprises a pump, a wireline reel, and a gauge to measure a wireline tension. The pump-down system also comprises a controller in communication with at least one of the pump and the wireline reel. The controller updates at least one of a pump rate of the pump and a wireline speed of the wireline reel based on a difference between the measured wireline tension and a reference wireline tension and at least one control parameter obtained at least in part from prediction model results.

Each of the embodiments, A and B, may have one or more of the following additional elements in any combination. Element 1: further comprising using a physics-based prediction model to determine the prediction model results. Element 2: further comprising using a statistics-based model to determine the prediction model results. Element 3: further comprising determining the prediction model results during pump-down of the tool. Element 4: further comprising determining the prediction model results before pump-down of the tool. Element 5: the at least one control parameter corresponds to an error scaling factor that is applied to the difference. Element 6: further comprising monitoring an inclination of the tool in the well and adjusting the reference tension based on the monitored inclination. Element 7: further comprising monitoring a temperature in the well and adjusting the reference tension based on the monitored temperature. Element 8: further comprising simulating a pump-down job using a prediction model, wherein the prediction model results correspond to simulation results. Element 9: the prediction model results correspond to a downhole wireline tension calculated as a function of a wireline speed, a pump rate, and at least one of a tool geometry, a tool inclination, a temperature, and a depth. Element 10: the prediction model results correspond to a surface wireline tension calculated as a function of a wireline speed, a pump rate, and at least one of a tool geometry, a tool inclination, a temperature, and a depth. Element 11: the prediction model results correspond to a surface pressure calculated as a function of a wireline speed, a pump rate, and at least one of a tool geometry, a tool inclination, a temperature, and a depth.

Element 12: the prediction model results and the at least one control parameter are dynamically adjusted during a pump-down job. Element 13: the prediction model results and the at least one control parameter are determined before a pump-down job begins. Element 14: the at least one control parameter corresponds to an error scaling factor to be applied to the difference. Element 15: further comprising at least one sensor to monitor tool inclination during a pump-down job, wherein the reference tension is adjusted based on the monitored tool inclination. Element 16: further comprising at least one sensor to monitor a downhole temperature during a pump-down job, wherein the reference tension is adjusted based on the monitored temperature. Element 17: further comprising a computer to simulate a pump-down job using a prediction model, wherein the prediction model results correspond to simulation results. Element 18: the prediction model results correspond to a surface or downhole wireline tension as a function of a wireline speed, a pump rate, and at least one of a tool geometry, a tool inclination, a temperature, and a depth.

Numerous variations and modifications will become apparent to those skilled in the art once the above disclosure is fully appreciated. For example, in at least some embodiments, the controller 90 may be associated with one or more operator interfaces. In such case, the control signals (CTRL1 and CTRL 2) may correspond to instructions displayed to one or more pump-down operators to direct manual pump-down control by the operators. Alternatively, CTRL1 and/or CTRL2 may be conveyed directly to wireline assembly 50 or pump assembly 64 to enable automated pump-down control. Further, manual adjustments to the one or more control parameters 92, the reference tension, the reference tension selection scheme, and/or the prediction model 91 before, during, or after a pump-down job may also be possible within predefined limits. A suitable operator interface for reviewing and selecting related prediction model and/or controller options may be provided for pump-down operators. It is intended that the following claims be interpreted to embrace all such variations and modifications.

What is claimed is:

1. A pump-down method that comprises:

deploying a tool in a well via a wireline;

measuring a tension of the wireline;

determining a difference between the measured tension and a reference tension; and updating at least one of a pump rate and a wireline speed used for pump-down of the tool based on the difference and at least one control parameter obtained at least in part from prediction model results, wherein the prediction model results correspond to a downhole wireline tension calculated as a function of a wireline speed, a pump rate, and at least one of a tool geometry, a tool inclination, a temperature, and a depth.

2. The method of claim 1, further comprising using a physics-based prediction model to determine the prediction model results.

3. The method of claim 1, further comprising using a statistics-based model to determine the prediction model results.

4. The method of claim 1, further comprising determining the prediction model results during pump-down of the tool.

5. The method of claim 1, further comprising determining the prediction model results before pump-down of the tool.

6. The method of claim 1, wherein the at least one control parameter corresponds to an error scaling factor that is applied to the difference.

7. The method of claim 1, further comprising monitoring an inclination of the tool in the well and adjusting the reference tension based on the monitored inclination.

8. The method of claim 1, further comprising monitoring a temperature in the well and adjusting the reference tension based on the monitored temperature.

9. The method of claim 1, further comprising simulating a pump-down job using a prediction model, wherein the prediction model results correspond to simulation results.

10. The method of claim 1, wherein the prediction model results correspond to a surface wireline tension calculated as a function of a wireline speed, a pump rate, and at least one of a tool geometry, a tool inclination, a temperature, and a depth.

11. The method of claim 1, wherein the prediction model results correspond to a surface pressure calculated as a function of a wireline speed, a pump rate, and at least one of a tool geometry, a tool inclination, a temperature, and a depth.

12. A pump-down system that comprises:

a pump;

a wireline reel;

a gauge to measure a wireline tension; and a controller in communication with at least one of the pump and the wireline reel, wherein the controller updates at least one of a pump rate of the pump and a wireline speed of the wireline reel based on a difference between the measured wireline tension and a reference wireline tension and at least one control parameter obtained at least in part from prediction model results, wherein the prediction model results correspond to a surface or downhole wireline tension as a function of a wireline speed, a pump rate, and at least one of a tool geometry, a tool inclination, a temperature, and a depth.

13. The system of claim 12, wherein the prediction model results and the at least one control parameter are dynamically adjusted during a pump-down job.

14. The system of claim 12, wherein the prediction model results and the at least one control parameter are determined before a pump-down job begins.

15. The system of claim 12, wherein the at least one control parameter corresponds to an error scaling factor to be applied to the difference.

16. The system of claim 12, further comprising at least one sensor to monitor tool inclination during a pump-down job, wherein the reference tension is adjusted based on the monitored tool inclination.

17. The system of claim 12, further comprising at least one sensor to monitor a downhole temperature during a pump-down job, wherein the reference tension is adjusted based on the monitored temperature.

18. The system of claim 12, further comprising a computer to simulate a pump-down job using a prediction model, wherein the prediction model results correspond to simulation results.

* * * * *